US007779934B1

(12) United States Patent
Driver

(10) Patent No.: US 7,779,934 B1
(45) Date of Patent: Aug. 24, 2010

(54) FLEXIBLE/RIGID DRILLING ASSEMBLY

(76) Inventor: W B Driver, P.O. Box 335, Davis, OK (US) 73030

( * ) Notice: Subject to any disclaimer, the term of this patent is extended or adjusted under 35 U.S.C. 154(b) by 256 days.

(21) Appl. No.: 11/789,532

(22) Filed: Apr. 25, 2007

(51) Int. Cl.
*E21B 17/00* (2006.01)
*E21B 41/00* (2006.01)

(52) U.S. Cl. ..... 175/320; 175/317; 175/318

(58) Field of Classification Search ..... 175/320, 175/317, 318, 89, 90
See application file for complete search history.

(56) References Cited

U.S. PATENT DOCUMENTS

2001/0045302 A1* 11/2001 Mazorow ..... 175/67
2001/0052427 A1* 12/2001 Eppink et al. ..... 175/40
2004/0104051 A1* 6/2004 Moriarty et al. ..... 175/57
2005/0205304 A1* 9/2005 Gurjar et al. ..... 175/75
2006/0283635 A1* 12/2006 Moody et al. ..... 175/73

* cited by examiner

*Primary Examiner*—David J Bagnell
*Assistant Examiner*—James G Sayre

(57) ABSTRACT

A flexible/rigid drilling assembly that can be flexible enough to bend around and into a curved hole form a vertical well to the horizontal with a short horizontal hole extension. When the flexible/rigid drilling assembly is placed in the short horizontal hole extension it can be converted to a rigid assembly and provide stability for a drill bit on its end to drill a straight horizontal out into an oil, gas or water. High static drilling fluid pressure with low compression force on the flexible/rigid drilling assembly is used to keep it in a flexible configuration while being placed in the short horizontal hole extension. Then the flexible/rigid drilling assembly is rotated to release the high static drilling fluid pressure. With the high static drilling fluid pressure released and with the high compression forces required to operate the drill bit the flexible/rigid drilling assembly transition into its rigid configuration and provide stability for a drill bit in drilling a straight horizontal drain hole.

1 Claim, 8 Drawing Sheets

FLEXIBLE/RIGID DRILLING ASSEMBLY

CROSS-REFERENCE TO RELATED APPLICATIONS

Figure 1:
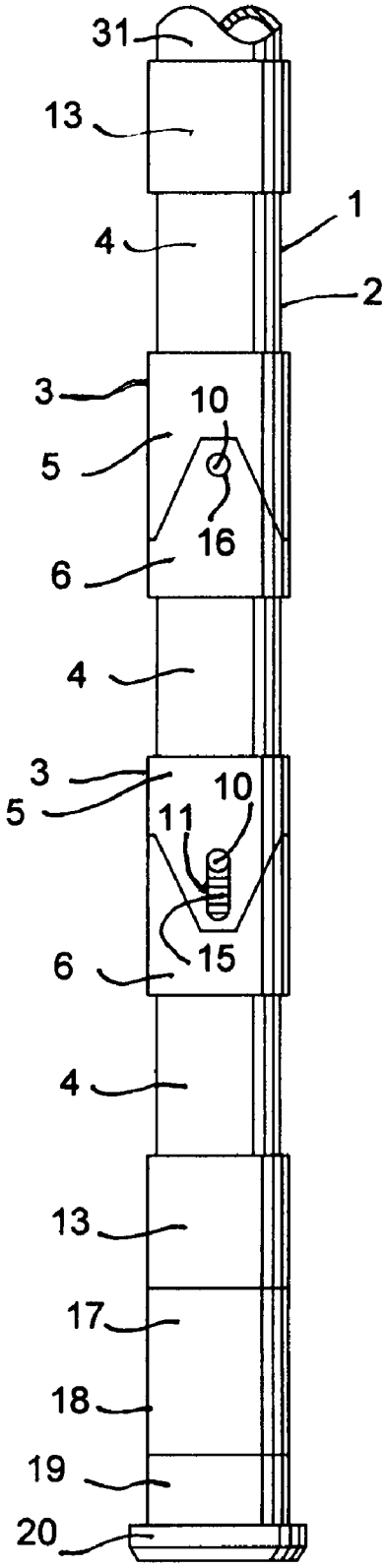

Not Applicable.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION-BY-REFERENCE OF MATERIAL SUBMITTED ON A COMPACT DISK

Not Applicable.

BACKGROUND OF THE INVENTION (1) Field of the Invention

This invention relates to u-joint, flexible drill pipes and equipment used to bore horizontal drain holes in oil, gas, or water formations.

(2) Description of Related Art

The way flexible drill pipes are used to drill horizontal holes from a vertical well hole is to drill a curved hole from the vertical to the horizontal and then proceed to drill a straight horizontal hole out into the formation.

The problem with standard flexible drill pipes in drilling horizontal drain holes in oil, gas or water formations is the flexibility required to operate around a curved hole from the vertical to the horizontal becomes a great problem in drilling a straight horizontal hole.

This invention provides a flexible/rigid drilling assembly, which can transition around the curved hole and converts to rigid assembly providing a rigid section right behind the drill bit. This rigid section will reduce the flexibility right behind the drill bit and provide more stability in drilling a straight horizontal hole. This capability could significantly increase the distance a horizontal hole can be drilled from a vertical well and increased the production from oil, gas or water wells.

SUMMARY OF THE INVENTION

It is an objective of the invention to provide a flexible/rigid drilling assembly that can pass around a predrilled curved hole with a short horizontal hole extended into an oil gas or water formation.

It is an objective of the invention as the flexible/rigid assembly passes into the horizontal hole it transitions from a flexible assembly to a rigid assembly and provides stability for the drill bit in drilling a straight horizontal drain hole.

It is an objective of the invention for the flexible/rigid assembly to comprise a flexible/rigid drill pipe, a valve, and a tool joint, which a drill bit, can be attached.

It is an objective of the invention for the flexible/rigid drill pipe be comprised of special flexible/rigid u-joints joined together by short tube sections, with the ends of the flexible/rigid drill pipe having the tube sections connected to couplings that can connect to a standard flexible drill pipe or a valve.

It is an objective of the invention for the flexible/rigid u-joints to be designed to support the flow of drilling fluids and or maintain static or near static drilling fluid pressure, and under drilling fluid regulation and down hole drilling force on the flexible/rigid drill pipe convert from a flexible u-joint to a rigid u-joint as shown in more detail in this specification.

It is an objective of the invention provide a tool joint which has internal threads on one end for attachment to a drill bit and external threads on the other end for attachment to a valve. Extending from the end of the tool joint with the external thread is a valve stem with its axial center the same as the tool joint.

It is objective of the invention to provide a valve that connects the tool joint to a coupling on the end of the flexible/rigid drill pipe. The distance the external threads of the tool joint are advanced into the valve will determine when the valve is open or closed.

It is objective of the invention for the operation for the operation of the flexible/rigid drilling assembly to be as follows: before the flexible/rigid drilling assembly is started down a well hole with a bit attached to the tool joint and the up hole end of the flexible/rigid drill pipe attached to a standard flexible drill pipe, the valve is closed by partially backing the tool joint external threads out of the valve. Just before the flexible/rigid drilling assembly enters the curved hole with the short horizontal hole extension the flexible/rigid drill pipe will be pressured with static or near static drilling fluids. Then the flexible/rigid drilling assembly will be inserted around the curved hole through the short horizontal hole extension until the drill bit interfaces with formation. The standard flexible drill pipe will rotate the flexible/rigid drill pipe until the valve advances all the way on the external threads of the tool joint and the valve will be fully open. When the valve is open the static or near static pressure with be greatly reduced and with down hole drilling force from the standard flexible drill pipe the flexible/rigid u-joints in the short horizontal hole will become ridged forming a rigid section behind the drill bit.

DRAWINGS—FIGURES

In the accompanying drawings

FIG. 1 Illustrated is the flexible/rigid drilling assembly in the ridged configuration.

Figure 2:
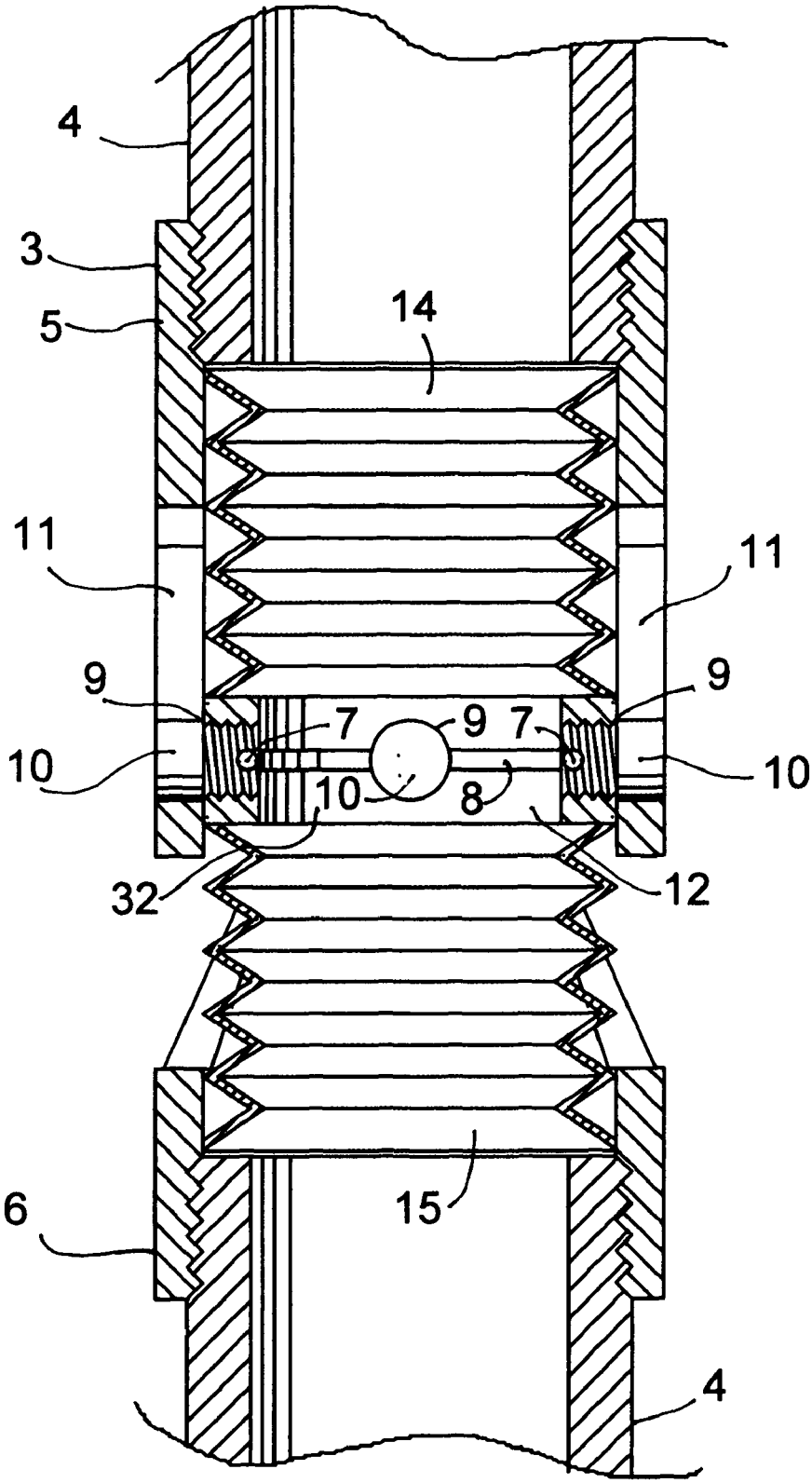

FIG. 2 Illustrated is a cross section of a flexible/rigid u-joint in the flexible configuration.

Figure 3:
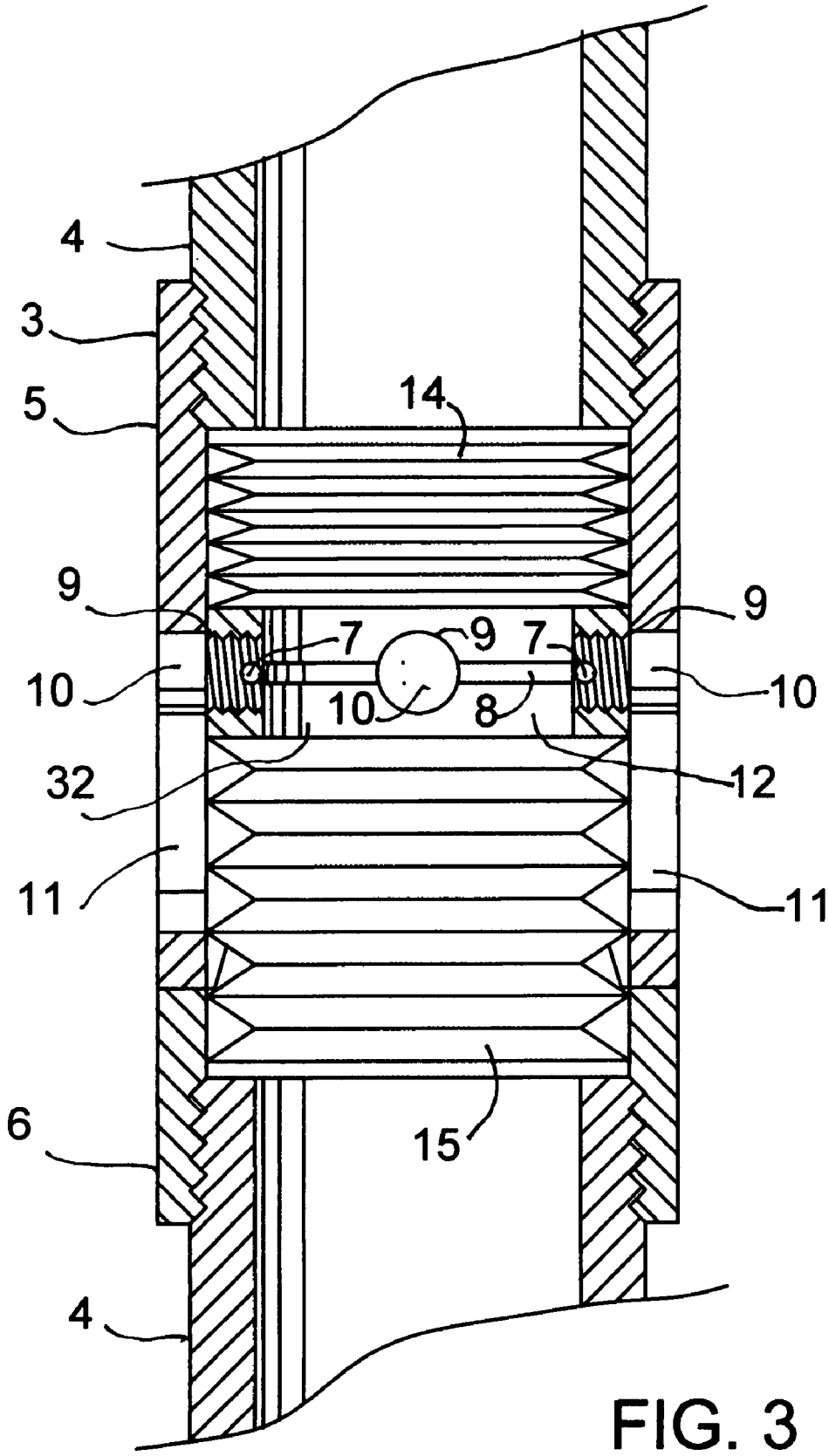

FIG. 3 Illustrated is a cross section of a flexible/rigid u-joint in the ridged configuration.

Figure 4:
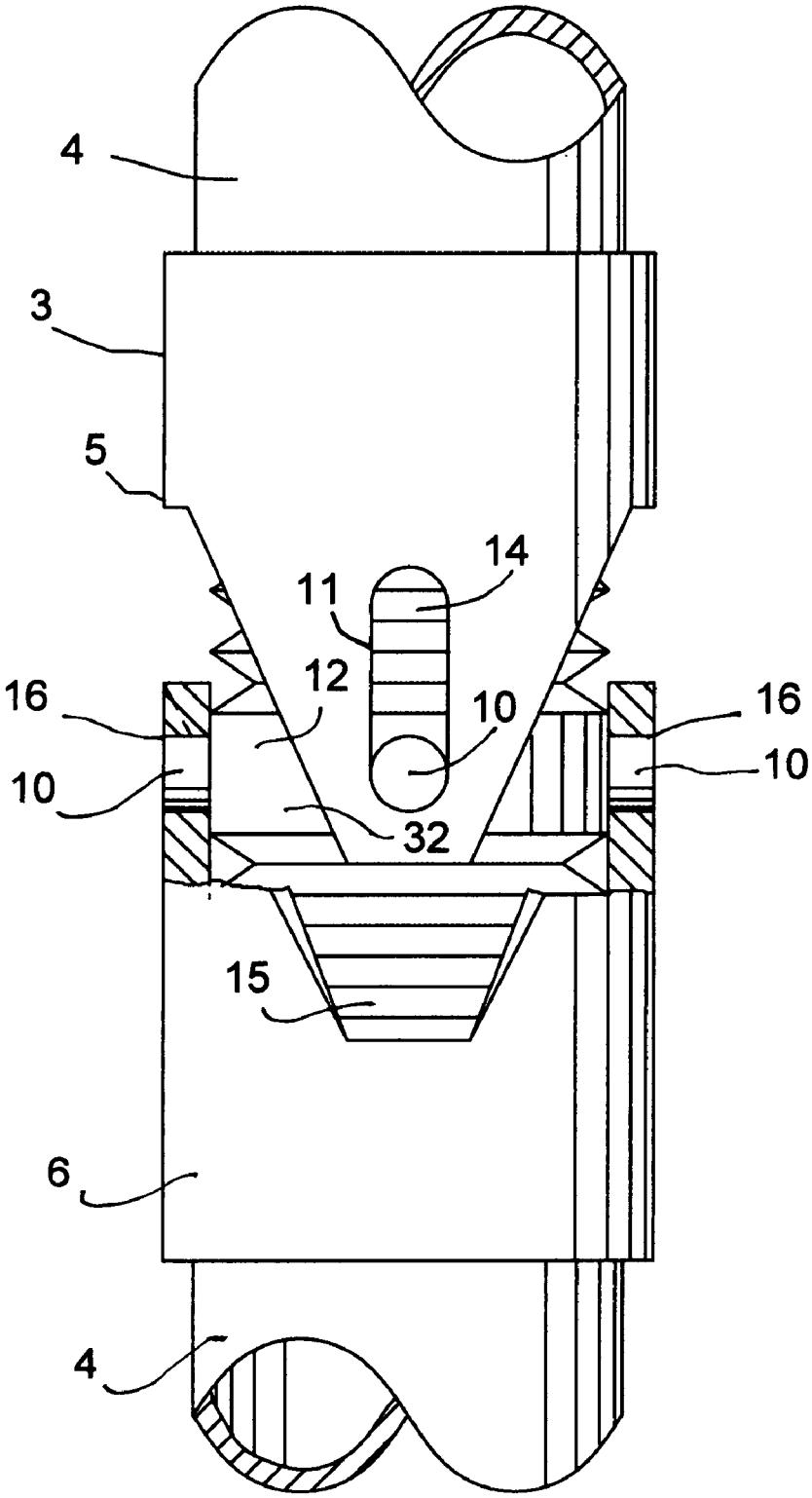

FIG. 4 Illustrated is a view of a flexible/rigid u-joint in the flexible configuration with some cut away.

Figure 5:
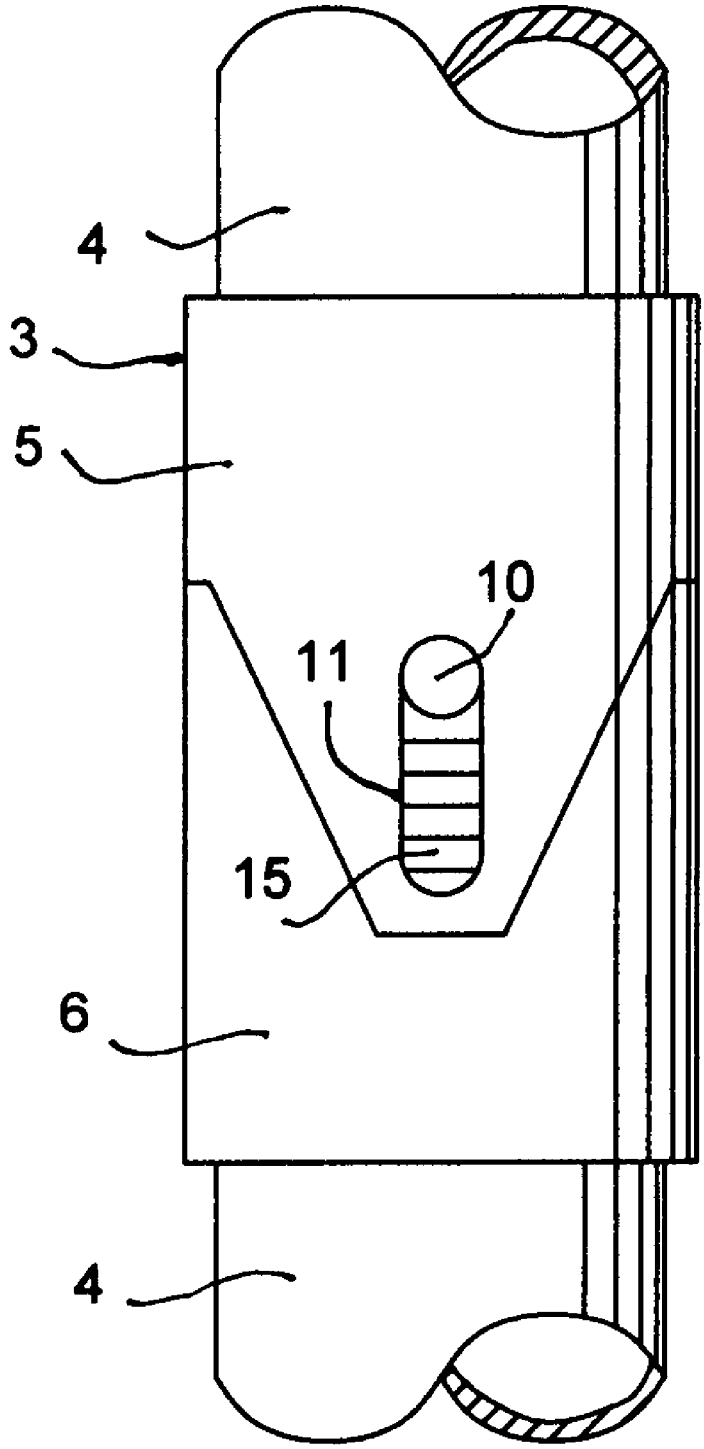

FIG. 5 Illustrated is a view of a flexible/rigid u-joint in a ridged configuration.

Figure 6:
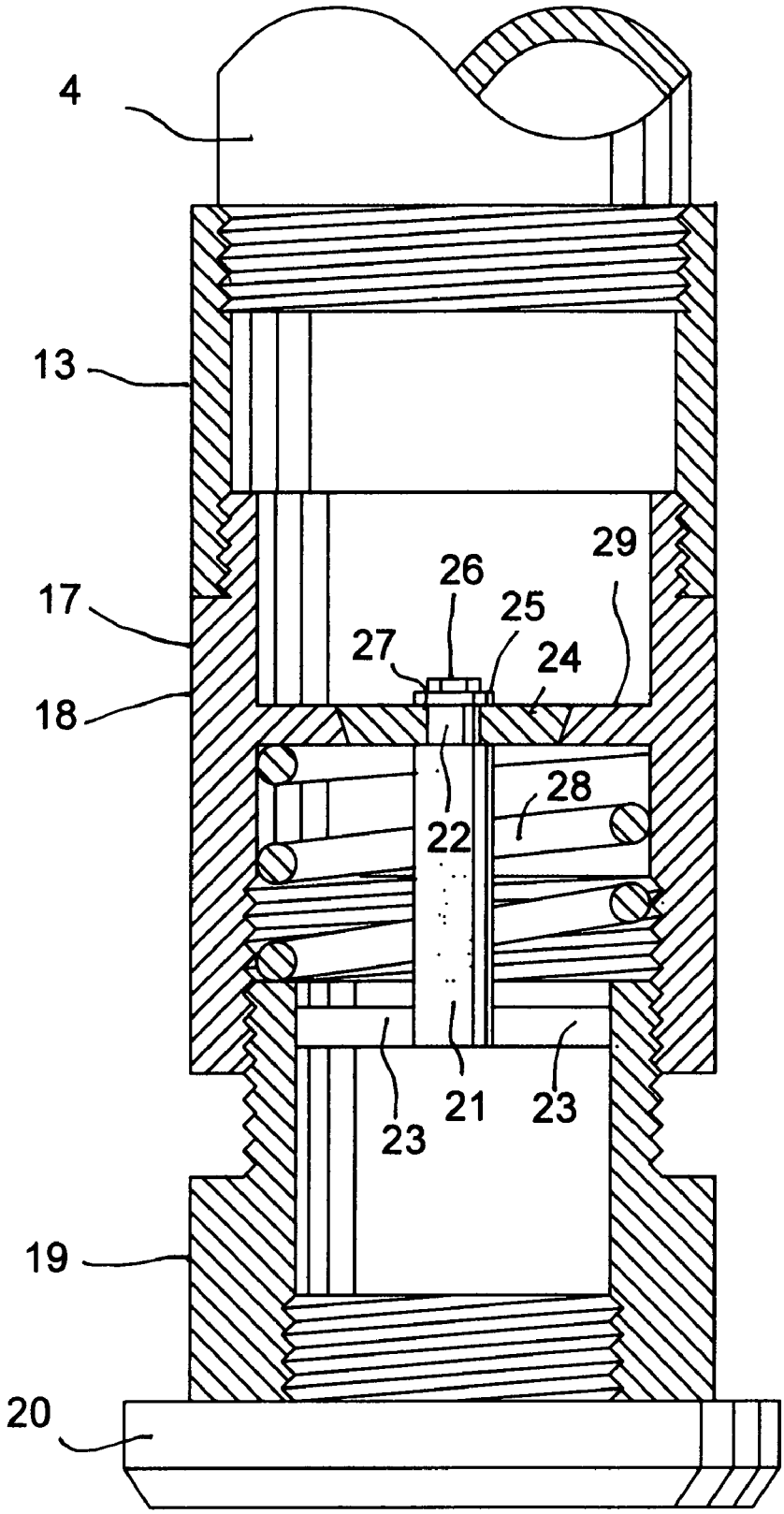

FIG. 6 Illustrated is a cross sections a valve, coupling and tool joint with the valve in the closed position.

Figure 7:
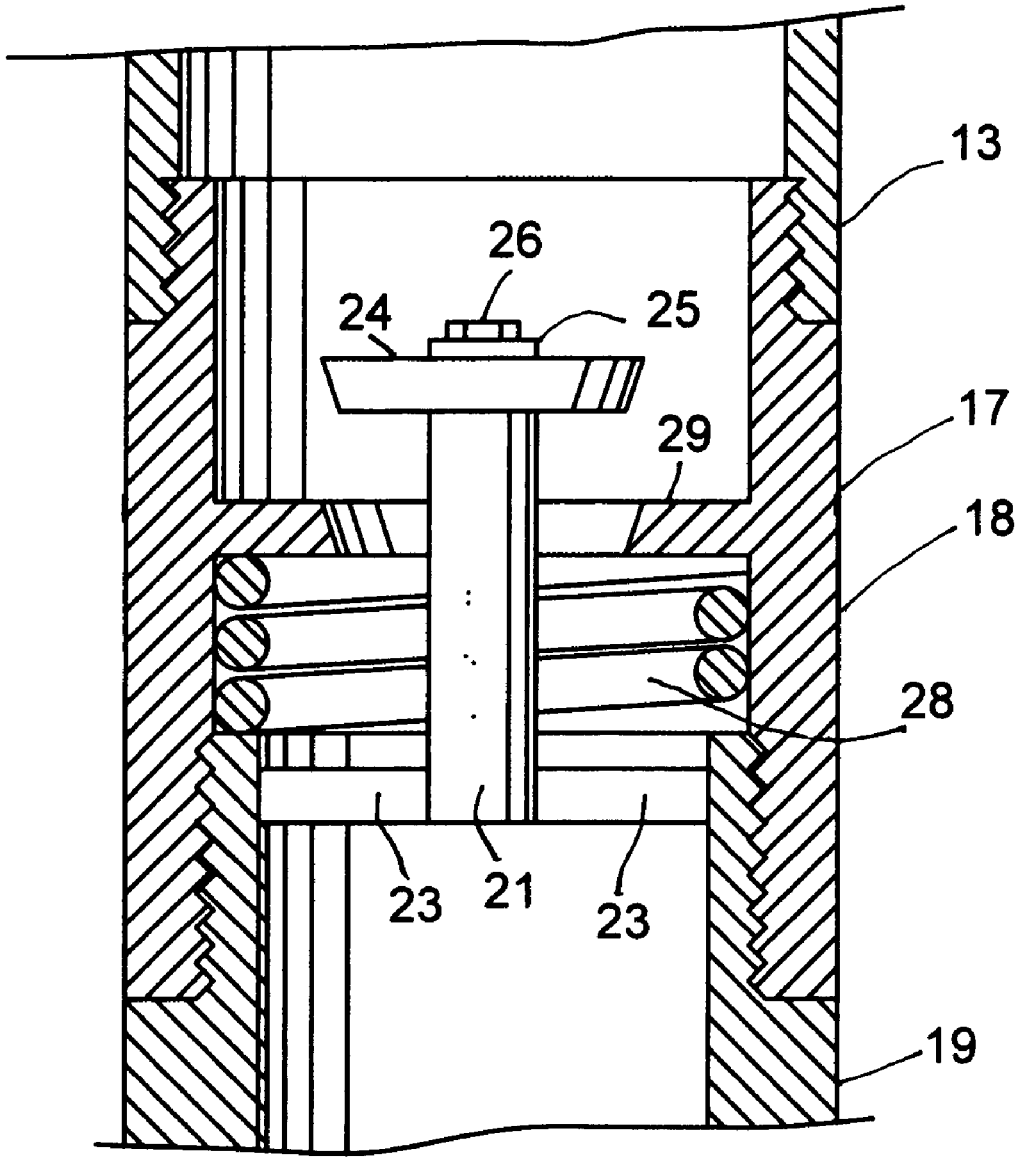

FIG. 7 Illustrated is a partial cross section of the tool joint and coupling with a full cross section of the valve in the open position.

Figure 8:
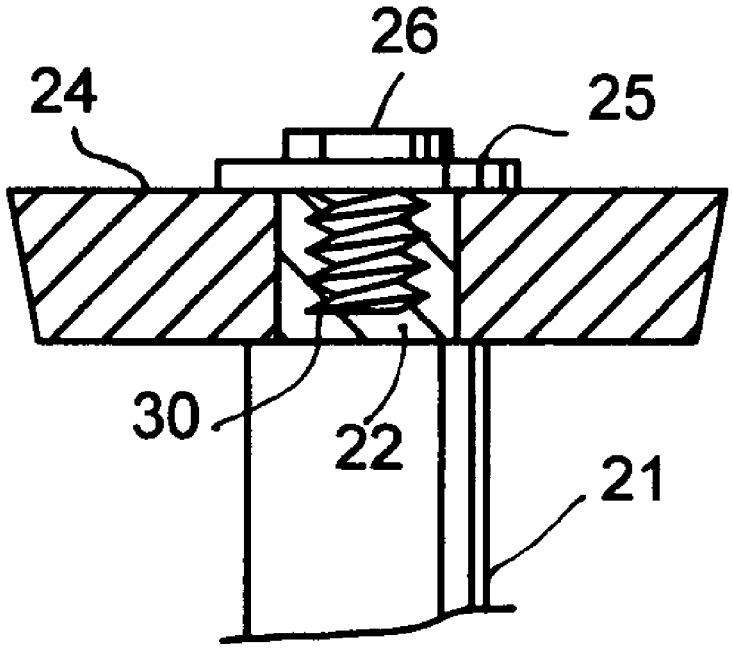

FIG. 8 Illustrated is how the valve gate is attached to the valve stem.

REFERENCE NUMERALS

| | |
|---|---|
| 1. | Flexible/rigid drilling assembly |
| 2. | Flexible/rigid drill pipe |
| 3. | Flexible/rigid U-joint |

-continued

| | |
|---|---|
| 4. | Short tube section |
| 5. | Gear shaped Fork |
| 6. | Gear shaped Fork |
| 7. | Retaining pin hole |
| 8. | Groove |
| 9. | Threaded stud hole |
| 10. | Stud with a end portion threaded |
| 11. | Attaching channel |
| 12. | Round rectangular shaped Ring |
| 13. | Coupling |
| 14. | Bellows |
| 15. | Bellows |
| 16. | Attaching hole |
| 17. | Valve |
| 18. | Valve housing |
| 19. | Tool Joint |
| 20. | Drill bit |
| 21. | Valve Stem |
| 22. | Short section, of reduced diameter |
| 23. | Valve stem supports |
| 24. | Valve gate |
| 25. | Valve gate retaining washer |
| 26. | Valve gate retaining bolt |
| 27. | Valve gate center hole |
| 28. | Compression Spring |
| 29. | Valve seat ring |
| 30. | Threaded bolt hole |
| 31. | Standard flexible drill pipe string |
| 32. | Center Section |

DESCRIPTION OF THE INVENTION

In FIG. 1 the flexible/rigid drilling assembly 1 is shown in the rigid configuration. It is comprised of flexible/rigid drill pipe 2, valve 17, tool joint 19 with an attached drill bit 20. Also the flexible/rigid drilling assembly 1 is shown attached to a standard flexible drill pipe string 31.

The flexible/rigid drill pipe 2 is comprised of a plurality of flexible/rigid u-joints 3 connected with short tube sections 4. At the end of the flexible/rigid drill pipe 2 the short section 4 extending from a flexible/rigid u-joint 3 is connected to coupling 31 for connecting to a valve 17 and the standard flexible drill pipe string 31. In FIG. 1 the flexible/rigid drill pipe 2 is shown with only two flexible/rigid u-joints 3 due to drawing size limitations. The flexible/rigid u-joint 3 as shown in FIG. 2, FIG. 3 and FIG. 4 that are constructed of gear shaped fork 5 with channels 11 and gear shaped fork 6 with holes 16. Gear shaped fork 5 and gear shaped fork 6 are constructed with the gear shaped fork on one and internal threads on the other end for attaching flexible/rigid u-joint 3 to a short tube section 4. The center section 32 of the flexible/rigid u-joint 3 is constructed with a round rectangular shaped ring 12 with four threaded stud holes 9 through the wall of the ring 12 equally spaced around the circumference of ring 12. Four studs 10 with a threaded end portion and with a retaining pin hole 7 near the end of the threaded end portion. The four studs 10 are used in the threaded holes to hold the gear shaped fork 5 and gear shaped fork 6 to the center section 32. A groove 8 is cut around the inside diameter of ring 12 deep enough for the retaining pin hole 7 to be accessed. The diameter of ring 12 equal to or slightly less than the inside diameter of gear shaped fork 5 and gear shaped forks 6. The gear shaped fork 6 will have two attaching holes 16 through the wall of gear shaped fork 6 with a diameter that is equal or slightly larger than the diameter of stud 10 near the end of the standard gear shaped fork 6. See FIG. 1 and FIG. 4. Gear shaped fork 5 has two channels 11 through the wall of gear shaped fork 5. The channels 11 will have rounded ends and start near the end of gear shaped fork 5 and will be parallel to the axial center of gear shaped fork 5 and extend long enough for gear shaped fork 5 to slip over ring 12 and fit together with gear shaped fork 6 to form flexible/rigid u-joint 3 into a rigid joint. See FIG. 1, FIG. 2, FIG. 3, FIG. 4 and FIG. 5. The width of the channels 11 is equal to or slightly larger than the diameter of a stud 10.

One end of bellows 15 will attached to the side of ring 12 and the other end of bellows 15 will attach to the inside diameter of gear shaped fork 6. One end of bellows 14 will be attached to the side of ring 12 and its other end is attached to the inside diameter of gear shaped fork 5. Ring 12, bellows 14 and bellows 15 will form a conduit which drilling fluids can flow through the flexible/rigid drill pipe 2 and when required hold static pressure inside flexible/rigid drill pipe 2.

The reason gear shaped fork 6 has attaching holes 16 instead of channels 11 like gear shaped fork 5 is for stability of flexible/rigid u-joint 3 and limit twisting forces on the bellows 14 and bellows 15.

Valve 17 is attached to a coupling 13 of flexible/rigid drill pipe 2. See FIG. 1, FIG. 6 and FIG. 7. The valve housing 18 of valve 17 has external thread on one end to connect to coupling 13 and internal threads on the other end to connect to tool joint 19. Valve housing 18 has a valve seat ring 29 extending from around the inside diameter of valve housing 18. The internal diameter of seat ring 29 is chamfered to interface with the outside diameter of valve gate 24. The chamfered internal diameter is chamfered form the side of valve seat ring 29 facing the end of valve housing 18 with the external threads.

Tool joint 19 has external threads on one end for attaching to valve 17 and internal threads on the other end for attaching a drill bit 20. See FIG. 1, FIG. 6, and FIG. 7. A valve stem 21 protrudes from the end of tool joint 19 that has the external threads. The axial center of the valve stem 21 is the same the axial center of tool joint 19. The valve stem 21 is held in place by two or more valve stem supports 23 attached to the end portion of valve stem 21 and attached to the inside wall of tool joint 19. The end of valve stem 21 that extends from tool joint 19 has a short section 22 of reduced diameter that has a length the thickness of valve gate 24 and a diameter the same are slightly less that the center hole 27 through valve gate 24. The short section 22 of reduced diameter has a thread bolt hole 30 through its axial center to accept retaining bolt 26 which with retaining washer 25 hold valve gate 24 on valve stem 21. The outside diameter of valve gate 24 is chamfered to interface with valve seat ring 29.

Before the valve 17 is attached to the coupling 13, the end of tool joint 19 with external threads is turned advancing the external threaded end of tool joint 19 into the valve housing 18 until valve stem 21 extends well through valve seat ring 29. The valve gate 24 is placed over the small diameter section 22 and retaining bolt 26 through retaining washer 25 is screwed into thread bolt hole 30 holding valve gate 24 on the end of valve stem 21. After the valve gate 24 has been placed on valve stem 21, tool joint 19 is turned backing a portion of its external thread out of valve housing 18 until valve gate 24 is seated in valve seat ring 29, which puts valve 17 in the closed configuration. With valve 17 in the closed configuration the external threads of valve housing 18 is screwed into coupling 13 attaching valve 17 to flexible/rigid drill pipe 2.

The compression spring 28 during the assembling of the tool joint 19 and valve 17 is placed between the end of tool joint 19 with the external threads and the side of the valve seat ring 29. The function of the compression spring 28 is to restrict minor forces from turning tool joint 19 while the flexible/ridged assembly 1 is being put into position for operation.

The flexible/rigid drilling assembly 1 with a drill bit 20 attached to the tool joint 19 is lowered into a vertical well hole by a standard flexible drill pipe string 31 until flexible/rigid assembly 1 is near a curved hole form a vertical well hole to the horizontal with a short horizontal hole extension is reached. Then a static drilling fluids pressure is induced into the flexible/rigid drilling assembly 1 which keeps bellows 14 from compressing keeping the flexible/rigid drill pipe 2 in its flexible configuration. With the flexible/rigid drill pipe 2 in its flexible configuration the standard flexible drill pipe string 31 pushes the flexible/rigid drilling assembly 1 around the curved hole into the horizontal hole extension until drill bit 20 is forced against the formation. With the drill bit 20 forced against the formation the standard flexible drill pipe string 31 rotates the flexible/rigid drilling assembly 1 advancing the valve housing 18 the full length of the external threads of tool joint 19 which puts tool joint 19 and drill bit 20 in rotation and also puts valve 17 in the open position. With valve 17 in the open position the static drilling fluid pressure is relieved and maximum drilling fluid flow is provided through the flexible/rigid drilling assembly 1. With the static drilling fluid pressure relieved and with the compression force applied by the standard flexible drill pipe string 31 for drill bit 20 to drill into the formation, the flexible/rigid drilling assembly 1 goes into its rigid configuration. The flexible/rigid drilling assembly 1 is able to go into its rigid configuration by bellows 14 of the flexible/rigid u-joints 3 to be compressed. The bellows 14 is compressed due to the release of the static drilling fluid pressure and the compression forces applied to the flexible/rigid drill pipe 2. When the bellows 14 compress the gear shaped fork 5 with channels 11 moves over the center section 32 engaging gear shaped fork 6 forming flexible/rigid u-joint into a rigid joint. With the flexible/rigid drilling assembly 1 in the rigid configuration it provides a rigid section right behind the drill bit 20 and increases the stability of drill bit 20 in drilling a straight horizontal hole out into the formation while being rotated by the standard flexible drill pipe string 31.

I claim:

1. A flexible/rigid drilling assembly that is attached to the down hole end of a standard flexible drill pipe string and is flexible while being placed around a predrilled curved hole from a vertical well hole to the horizontal with a short horizontal hole extension and then due to design and operation become rigid and provide stability to an attached drill bit in drilling a straight horizontal hole out into an oil, gas or water formation, the said assembly is comprised of a flexible/rigid drill pipe, a valve and a tool joint which a drill bit can be attached, said drill pipe is composed of a plurality of flexible/rigid u-joints, short tube sections with external threads on both ends used to connect the plurality of said u-joints and two couplings, each coupling being attached to a tube section extending from each said u-joint on each end of the assembled plurality of said u-joints, said u-joints are constructed of two gear shaped forks, a center section and two bellows, said center section is comprised of a round rectangular shaped ring with four threaded stud holes through the wall of the said ring equally spaced around said ring's circumference, said ring's diameter is equal or slightly less than the inside diameter of said forks, four studs with a threaded end portion and a retaining pin hole through said studs near the end of said threaded end portion, a groove is provided around the inside diameter of said ring that is deep enough for the said pin hole of said studs to be accessed, said forks of said u-joint are constructed with the gear shaped fork on one end and internal threads on the other end for connecting to said tube sections, one said fork will have holes through its wall near its end large enough for said stud to fit through for attachment to said ring, the other said fork will have channels with rounded ends through its wall starting near its end and running parallel to the axial center of the said fork with a width large enough for said stud to fit through for attachment to said ring and a length that will let the said fork with said channels slide over the center section and merge with said fork with said holes forming a rigid joint, a bellows with one end attached to the side of the said ring and its other end attached to the inside diameter of said fork with said holes, a bellows with one end attached to other side of said ring and its other end attached to the inside diameter of said fork with said channels, said bellows and said ring form a conduit which drilling fluids can flow through or hold drilling fluids under static pressure, said studs are screwed into said thread holes of said ring and said pin hole aligned with said groove, valve housing of said valve has external threads on one end for attaching to a said coupling and internal threads on the other end for attaching to said tool joint, a valve seat ring extends from around the inside diameter of said valve housing, the inside diameter of said seat ring is chamfered from the side of said seat ring facing the end of said valve housing with external threads, said tool joint has external threads on one end for attaching to said valve housing and internal threads on the other end of attaching to a drill bit, a valve stem extending form the end of said tool joint with the external threads, two or more valve stem supports attached to the end portion of the said valve stem inside said tool joint and said stem supports attaching to the inside wall of said tool joint holding said valve stem so the axial center of said valve stem will be the same as the axial center of said tool joint, end portion of the said valve stem extending from the end of said tool joint having a short section of reduced diameter from the said valve stem diameter, a valve gate, length of said short section the same as the thickness of said valve gate, the diameter of said short section large enough to fit through a center hole of a said valve gate, a threaded hole, said threaded hole through the axial center in the end of said short section, a retaining bolt, a retaining washer, said bolt through said washer screws into said threaded hole holding said valve gate on the end of said valve stem, said valve gate's outside diameter is chamfered to interface and fit into the chamfered inside diameter of said valve seat ring, said valve gate is closed by screwing the said external threads of the said tool joint out of internal threads of the said valve housing until the said valve gate seat into said valve seat ring putting said valve in the closed configuration, a compression spring, said spring is used between the end of the said tool joint with the external threads and the side of the said valve seat ring to restrict minor forces from turning the said tool joint while the said assembly is put in position for operation.

* * * * *